US005079867A

United States Patent [19]

Kober et al.

[11] Patent Number: 5,079,867

[45] Date of Patent: Jan. 14, 1992

[54] IRONER-FOLDER FOR FLATWORK, APPARATUS AND METHOD

[75] Inventors: Kasimir Kober, Niles; Martin Borucki, Chicago, both of Ill.

[73] Assignee: Chicago Dryer Company, Chicago, Ill.

[21] Appl. No.: 488,716

[22] Filed: Mar. 5, 1990

[51] Int. Cl.[5] ..... D06F 69/02; D06F 89/00

[52] U.S. Cl. ..... 38/2; 38/8; 38/11; 493/441; 493/444; 223/37

[58] Field of Search ..... 38/1 C, 1 D, 2, 7–9, 38/11, 12, 44, 48, 52, 56; 270/5, 8, 32; 100/5; 493/405, 419, 444, 413, 441; 198/349.5, 349.6, 349.9, 379, 380, 547, 577, 643, 807, 860.1; 271/12, 69, 309

[56] References Cited

U.S. PATENT DOCUMENTS

| | | | |
|---|---|---|---|
| 1,805,776 | 5/1931 | Mayer | 38/2 |
| 2,318,252 | 5/1943 | Myers | 38/2 |
| 2,330,977 | 10/1943 | Johnson | 38/2 |
| 2,914,320 | 11/1959 | Petre | 493/444 X |
| 2,954,974 | 10/1960 | Kellett | 270/80 |
| 3,031,780 | 5/1962 | Fredholm | 38/2 |
| 3,154,726 | 10/1964 | McClain | 493/441 X |
| 3,172,219 | 3/1965 | Hajos | 38/2 |
| 3,190,640 | 6/1965 | Stostrom | 38/2 X |
| 3,260,518 | 7/1966 | Kamberg | 270/62 |
| 3,361,424 | 1/1968 | Kamberg | 270/66 |
| 3,559,983 | 2/1971 | Stostrom | 38/2 X |
| 3,577,665 | 5/1971 | Kamberg | 38/2 |
| 3,589,709 | 6/1971 | Hey | 493/444 X |
| 3,680,852 | 8/1972 | Kamberg | 38/2 X |
| 3,706,450 | 12/1972 | Gerstenberger | 270/84 |
| 3,806,007 | 4/1974 | Grantham | 223/37 |
| 3,905,593 | 9/1975 | Bean | 493/441 X |
| 4,411,082 | 10/1983 | Ferrage | 38/9 |
| 4,569,672 | 2/1986 | Marion et al. | 493/444 X |

FOREIGN PATENT DOCUMENTS

| | | | |
|---|---|---|---|
| 1425865 | 3/1965 | France | 493/441 |
| 0300100 | 8/1968 | Sweden | 38/2 |

*Primary Examiner*—Werner H. Schroeder
*Assistant Examiner*—Ismael Izaguirre
*Attorney, Agent, or Firm*—Joseph P. Calabrese

[57] ABSTRACT

An ironer folder is provided in which an ironed flatwork item such as a sheet is folded into quarter panels along its length by a pivoting arm. The folded sheet is placed on a sequence of conveyors which carry the folded flatwork into engagement with a series of three cross-folding stations whereby the flatwork may be cross-folded three times and discharged from the apparatus. The longitudinal and lateral free edges of the folded flatwork are interiorly disposed in the discharged folded item so as to present an attractive folded appearance having a periphery defined by continuous bight portions.

21 Claims, 7 Drawing Sheets

FIG. 1
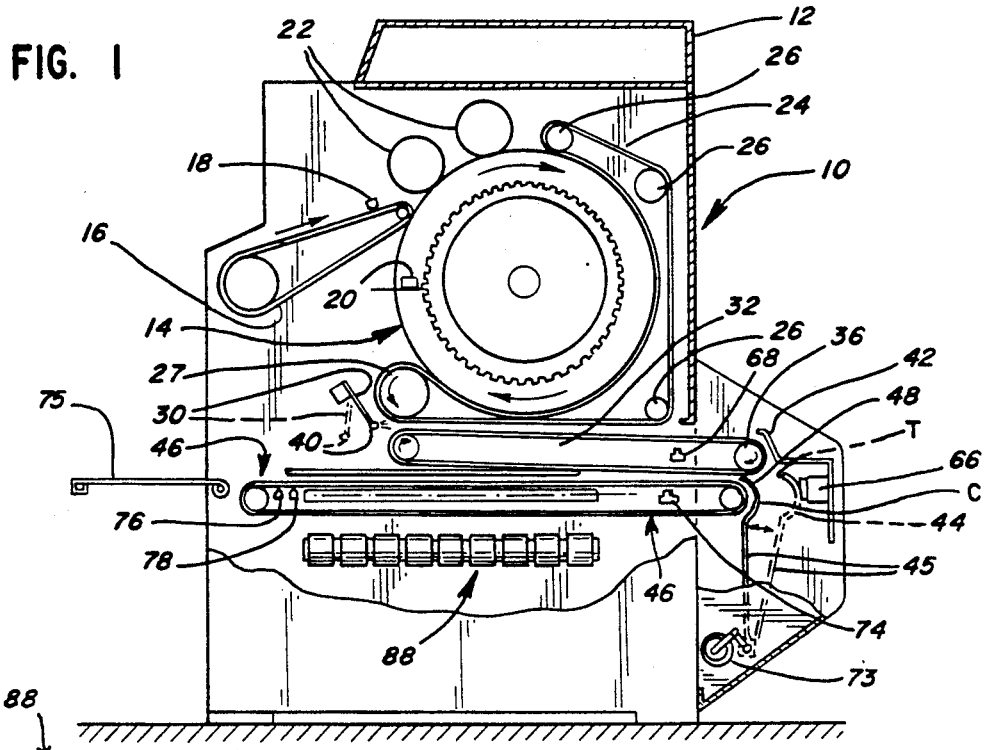
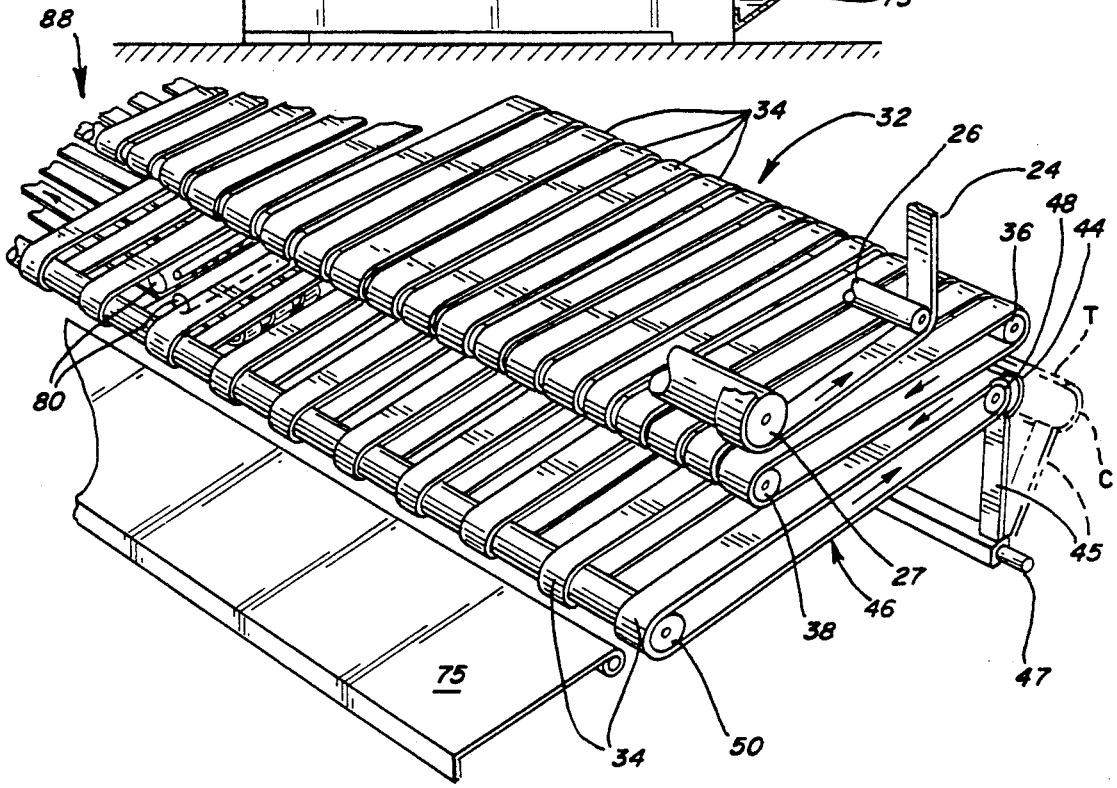
FIG. 2

FIG. 3
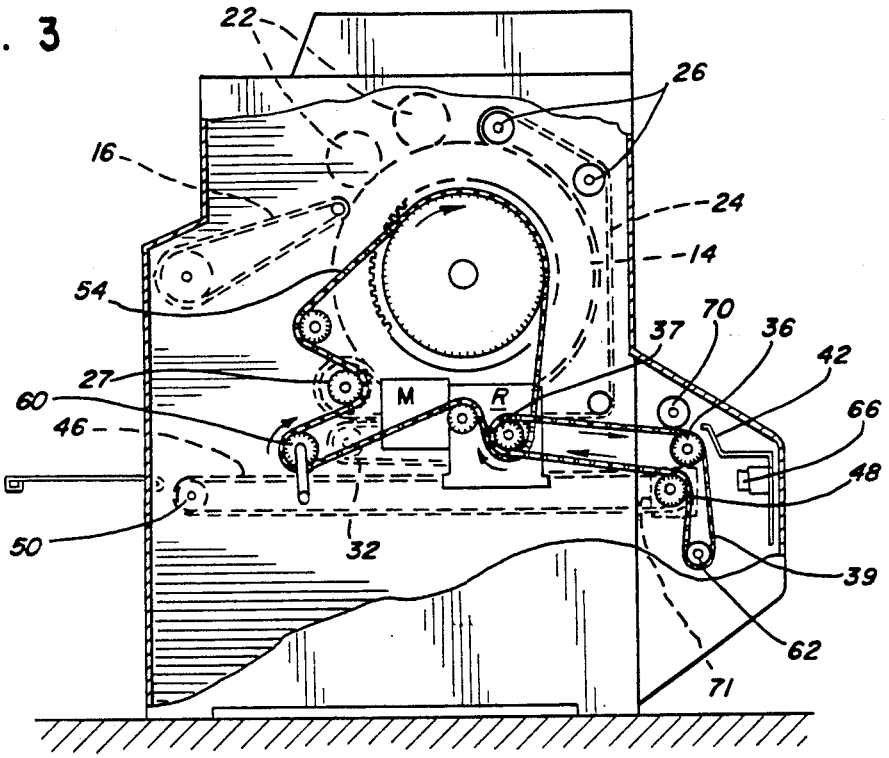
FIG. 4
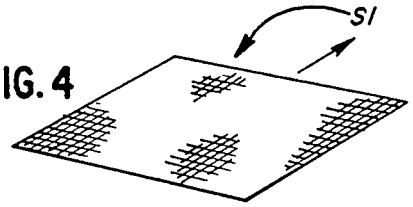
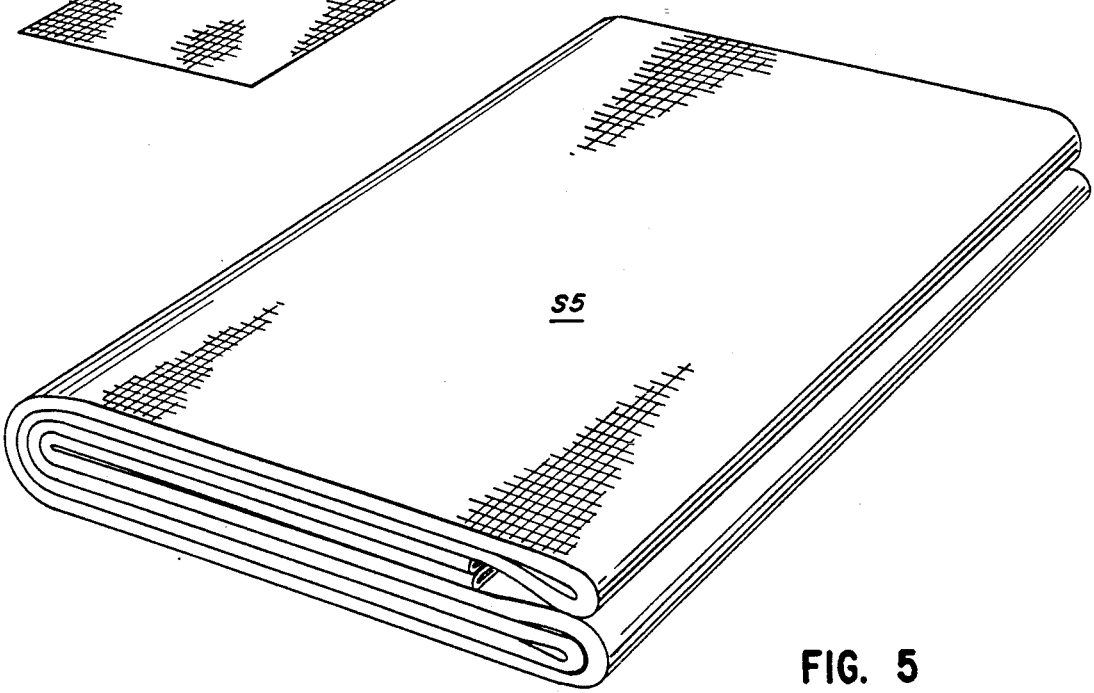
FIG. 5

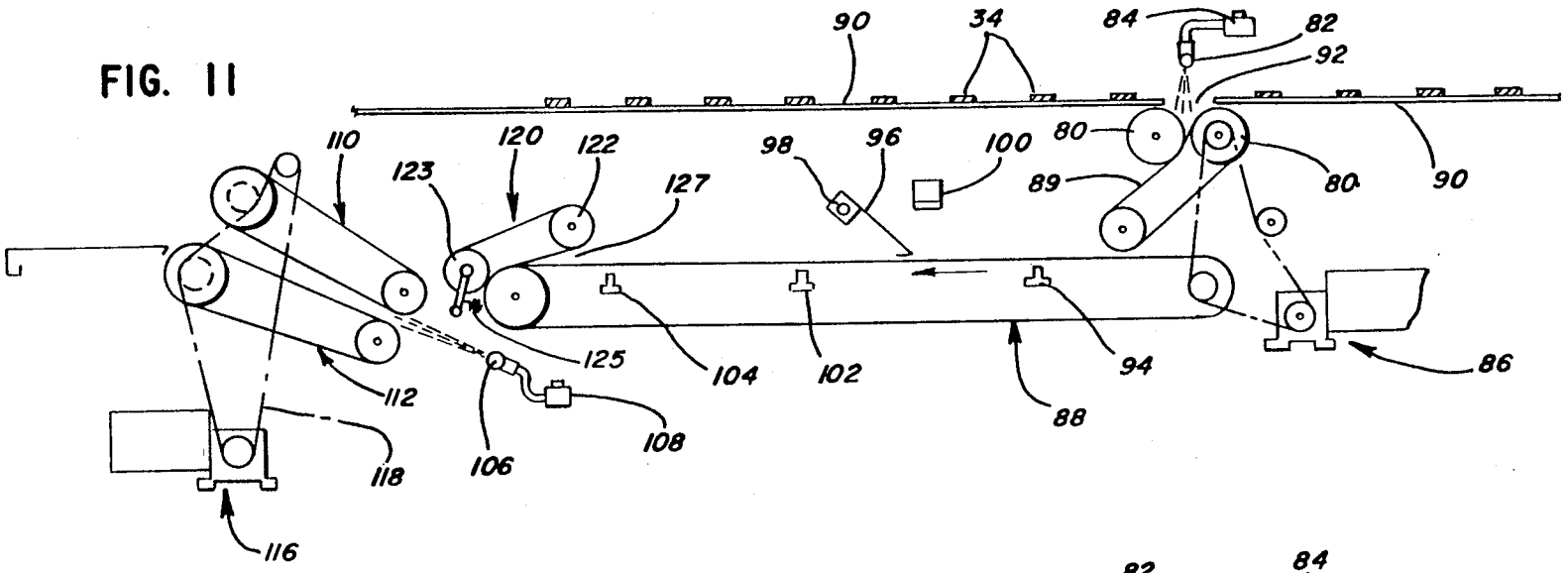
FIG. 11
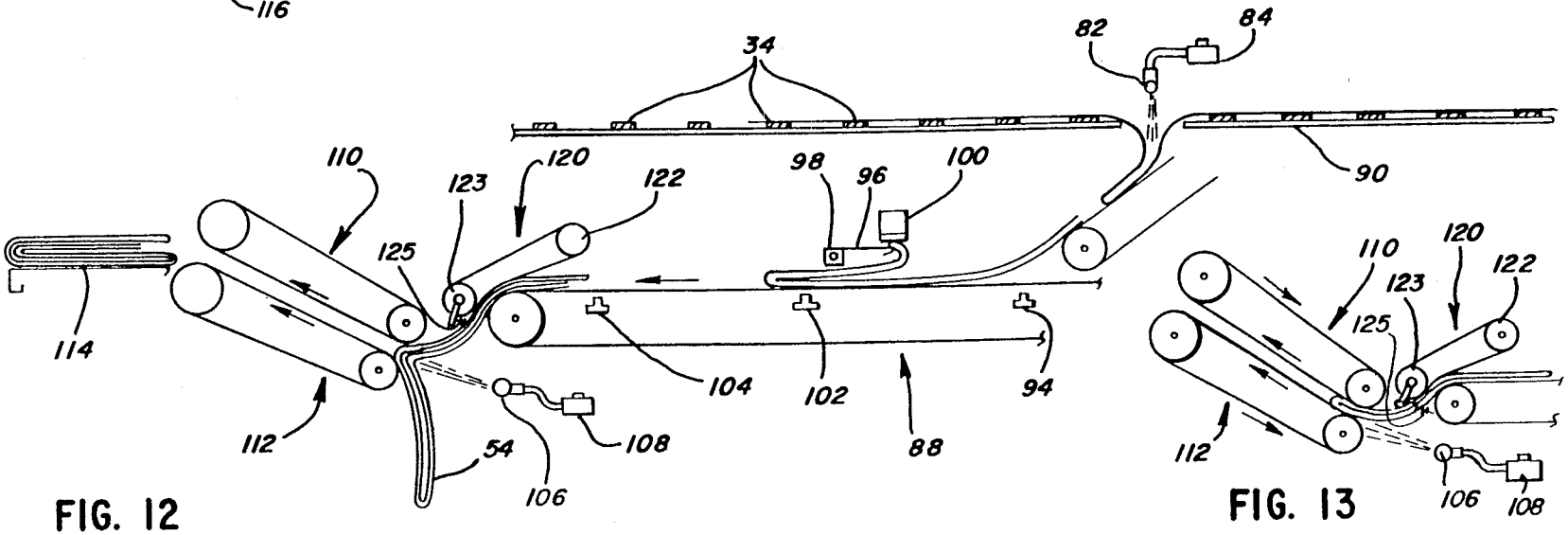
FIG. 12
FIG. 13

FIG. 15
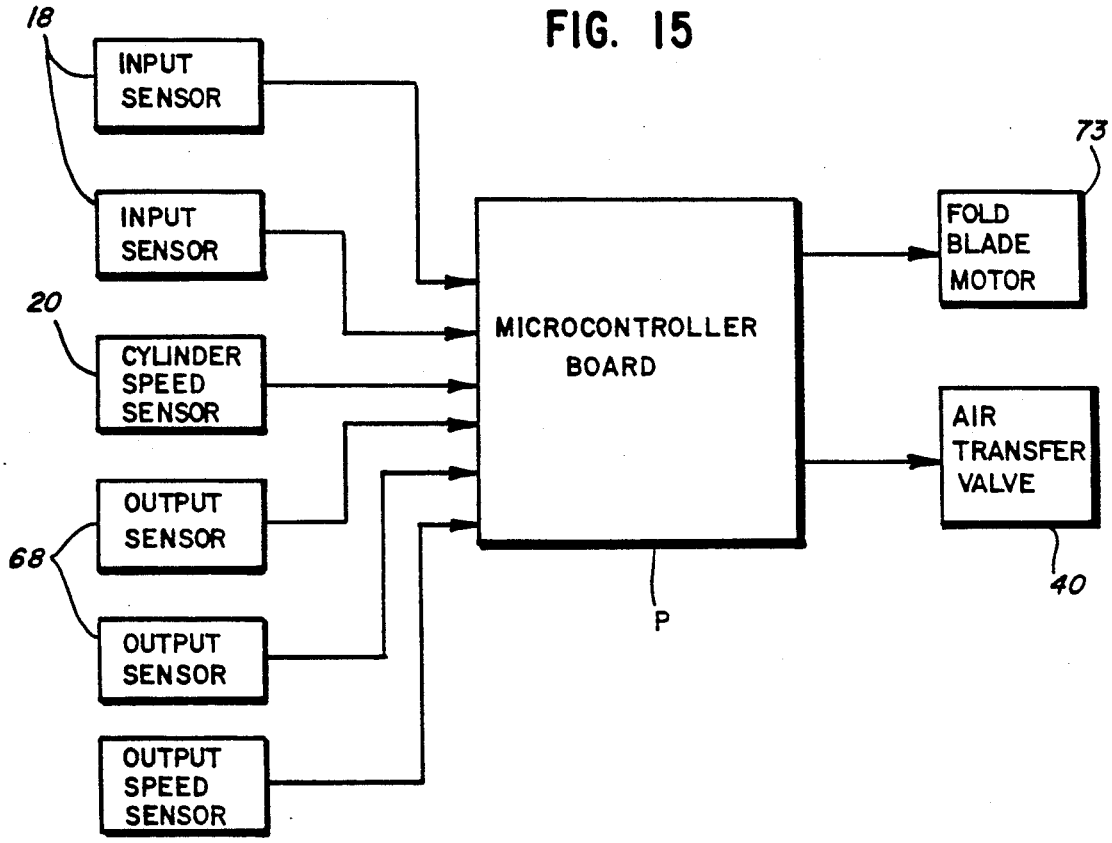
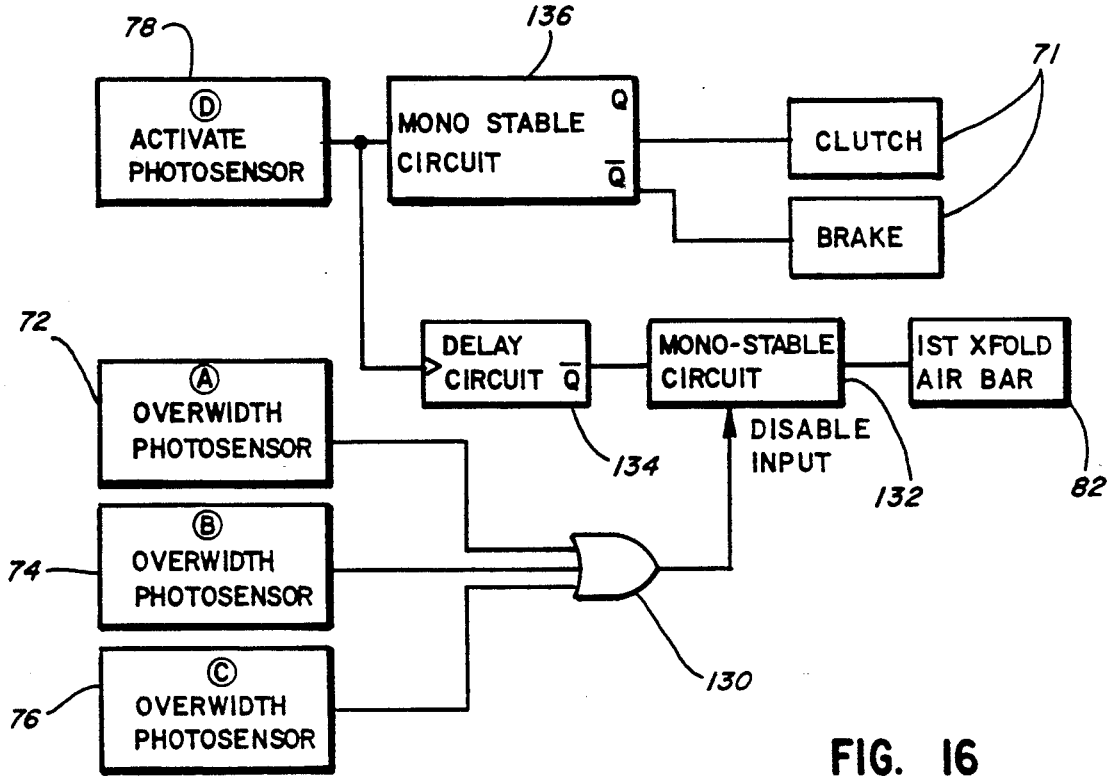
FIG. 16

FIG. 17
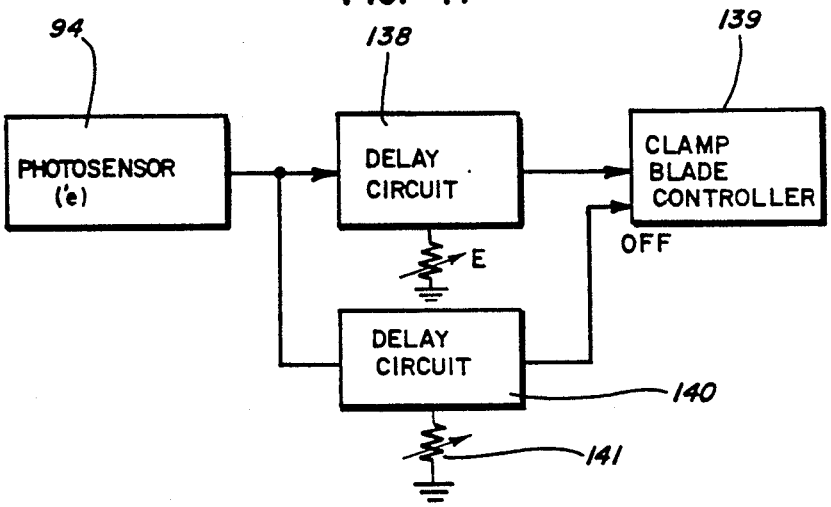
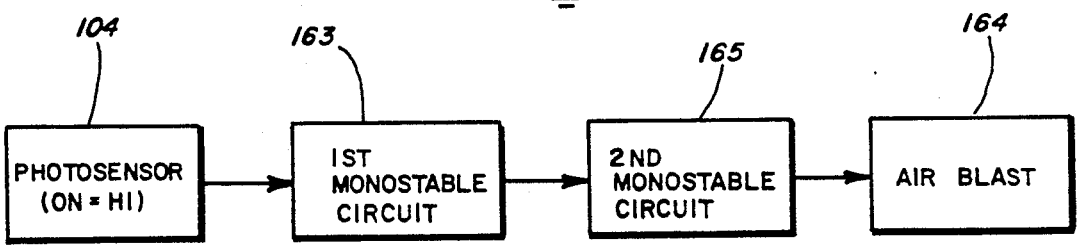
FIG. 19
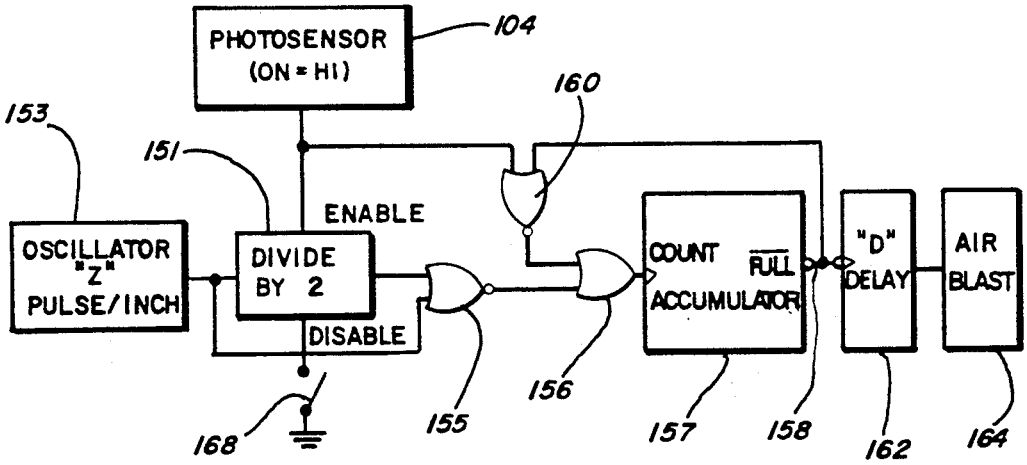
FIG. 18

IRONER-FOLDER FOR FLATWORK, APPARATUS AND METHOD

FIELD OF THE INVENTION

This invention relates to an ironer-folder construction of unique compactness, and more particularly pertains to apparatus adapted to not only iron flatwork but in addition performs a number of precise and varied folding steps.

BACKGROUND OF THE INVENTION

Apparatus for both ironing and folding flatwork such as sheets, pillowcases, tablecloths and similar laundry items has long been known in the art. Thus Mayer U.S. Pat. No. 1,805,776 is directed to a combined ironing and folding machine. Such early apparatus, however, commonly employed discrete ironing and folding apparatus in a series relationship occupying a maximum floor area with accompanying increased costs of operation.

With the passage of time improvements have been effected in combination ironer-folders. Thus, Ferrage U.S. Pat. No. 4,411,082 is directed to an ironing device with a pivoted blade folder which occupies a floor area little more than that of an ironing device alone. This patented apparatus folds ironed flatwork such as sheets into panels of desired width by means of a pivoting blade which feeds the finally folded sheet or the like onto a discharge conveyor. This patent discloses folding by means of a pivoting blade only, which is adapted to effect folds of desired panel width "L" which is programmed into the apparatus control.

The use of pivoting folding blades is also well known in the art being disclosed in the above patents as well as Kellett U.S. Pat. No. 2,954,974 directed to a laundry folding machine.

Patents such as Kamberg et al. 3,260,518 and Kamberg U.S Pat. No. 3,361,424 disclose folding apparatus employing retractable clamp means which fold flatwork moving on a conveyor by lifting the leading edge of a moving sheet or the like and dropping it on the sheet trailing edge. The folders of these two patents also employ counter-rotating pinch rolls in combination with air-blasts for cross-folding flatwork in the course of being processed by the apparatus.

These two patents are assigned to the assignee of this application, and the disclosure thereof is incorporated herein by reference.

The prior art apparatus directed to ironer-folders are limited in their capabilities and oftentimes are inefficient in their use of floor space. The prior art devices also form folds of generally limited and imprecise configuration in the ironed flatwork being processed.

SUMMARY OF THE INVENTION

It is an object of this invention therefore to provide an ironer-folder of varied capabilities which is compact and efficient in design.

It is another object of this device to provide an ironer-folder construction adapted to effect folding of ironed flatwork in as many as four separate folding stations employing various flatwork-engaging and folding techniques. The various stations employ limited numbers of components which contribute to trouble-free operation and desired long apparatus life.

It is a further object of this invention to provide a high-production ironer-folder employing a series of safeguards to insure precisely folded sheets of desired appearance.

It is yet another object of this invention to provide an ironer-folder adapted to automatically fold ironed flatwork of varying length into panels defined by precise folds, and of predetermined width, or length fraction, without the need for operator intervention.

The above and other objects of this invention will become more apparent from the following description when read in the light of the accompanying drawings and appended claims.

In one embodiment of an ironer-folder made in accordance with this invention a rotating ironing roll or cylinder discharges ironed flatwork onto a first conveyor which in turn discharges such flatwork or to a swinging or pivoting substantially C-shaped retainer-stuffer arm whereby flatwork fold panels of substantially equal width straddle the arm. The final arm pivotal movement feeds the arm-folded flatwork onto a second ribbon conveyor proceeding beneath the ironing cylinder. The second conveyor is stopped in a predetermined position beneath the cylinder and an overlying air bar emits an air blast forcing the transverse central axis of the stationary flatwork between conveyor ribbons into the bite of underlying pinch rolls. The rolls deposit the cross-folded flatwork onto a third underlying ribbon conveyor running beneath and parallel to the axis of the ironing roll. While moving beneath the ironing cylinder, the flatwork is cross-folded twice prior to being forced onto a discharge conveyor assembly which passes the ironed and folded flatwork to the exterior of the ironer-folder. Various flatwork sensing means are disposed along the path of movement of the flatwork for actuating the various folding elements and associated apparatus components as will hereinafter be explained in greater detail.

DESCRIPTION OF THE DRAWINGS

FIG. 1 is a schematic side elevational view partly broken away of an ironer-folder made in accordance with this invention and illustrating various conveyors and drive rolls incorporated therein.

FIG. 2 is a fragmentary perspective view of conveyors of endless ribbons employed in the ironer-folder of this invention.

FIG. 3 is a view similar to FIG. 1 illustrating the drive elements including drive chains and sprockets schematically illustrated, employed in the ironer-folder of this invention.

FIG. 4. is a perspective view illustrating a typical item of flatwork which may be processed in the ironer-folder of this invention.

FIG. 5 is a perspective view illustrated on an enlarged scale of the flatwork item of FIG. 4 following processing in the ironer-folder of this invention.

FIG. 11 is a schematic side elevational view illustrating conveyor systems and drive means therefor employed in three folding stations employed in the ironer-folder of this invention.

FIG. 12 is a view similar to FIG. 11 in which conveyors only are illustrated together with a schematic representation of a flatwork item in the course of being processed in the three folding stations represented.

FIG. 13 is a schematic side elevational view of the third cross-folding station of FIG. 12 in which the flat work item is not folded in such station but bypassed therethrough without any cross-folding.

FIG. 15 is a functional block diagrams, generally schematic, illustrating the electrical relationship of apparatus elements in the primary folding station of the provided apparatus.

FIGS. 16–19 are circuit diagrams relating to circuitry employed in the first, second and third cross-folding stations through which flatwork progresses in the ironer-folder of this invention prior to being discharged from the apparatus.

DESCRIPTION OF THE PREFERRED EMBODIMENTS

Figure 6:
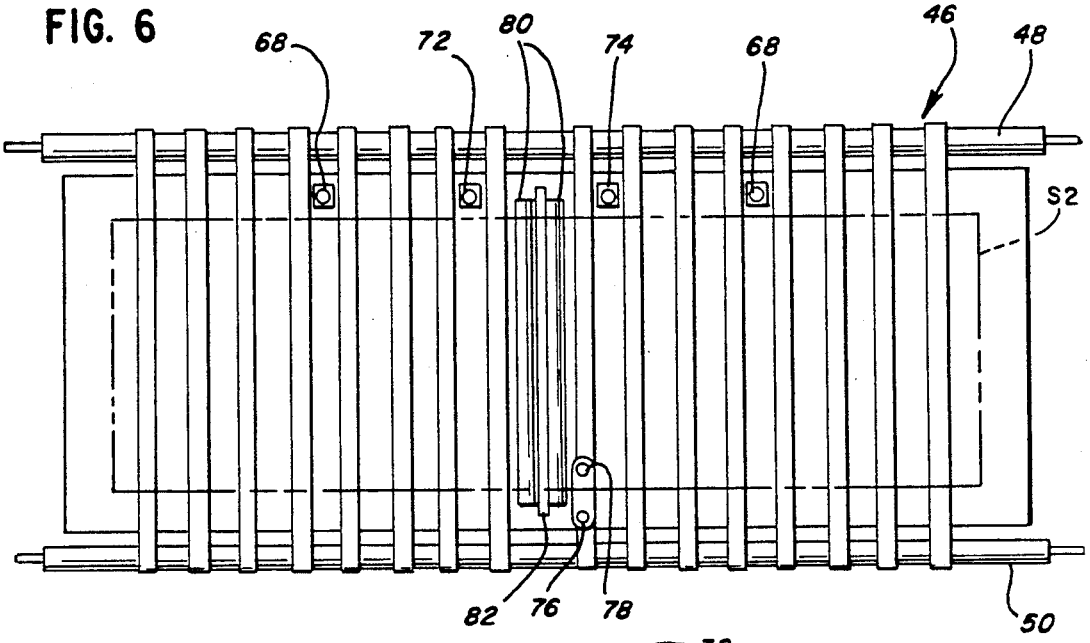
FIG. 6 is a plan view of a flatwork conveyor employed in the ironer-folder of this invention together with an illustration of the relative disposition of photosensors and primary cross folding rolls employed in the ironer-folder of this invention.

Referring now more particularly to FIG. 1, an ironer-folder 10 is therein illustrated in side elevation. The ironer-folder comprises an outer housing 12 illustrated in section within which is rotatably mounted in an upper portion thereof between opposed side frames, an ironer cylinder 14. The latter is internally heated by means such as gas, steam or thermal liquid for removing moisture from flatwork such as sheets, tablecloths and the like adapted to be ironed by the smooth outer periphery of cylinder 14. The flatwork may be fed onto such outer periphery by means of a feed conveyor 16, onto which an operator or operators manually feed the flatwork, automatic apparatus not illustrated but known in the art may also feed flatwork onto conveyor 16.

Disposed over the feed conveyor 16 are spaced photosensors 18 which straddle the transverse mid-point of the feed conveyor 16 and cylinder 14 and are spaced apart approximately 34 inches. The spacing may be varied as desired, and the sensors are intended to sense the leading edge of flatwork being processed. Such flatwork may comprise small items such as tablecloths or large items such as king size sheets which are approximately 110 by 108 inches; such a sheet is schematically illustrated in FIG. 4 of the drawing. The sensors 18 which are in transverse alignment sense the leading edge of the flatwork item being processed by the combination ironer-folder 10 and immediately, forward a sensing input signal to a microprocessor well known in the art mounted in micro controller board P illustrated in the block diagram of FIG. 15. The speed of the ironer cylinder 14 is known by virtue of a proximity switch 20 which senses the periphery of a sprocket of the cylinder 14 and the sensed speed is also conveyed to the microprocessor. The photosensors 18, are well known in the art, and may comprise Micro-Switch Model FE7B. During the sensing of a sheet or the like by sensors 18, pulses from the proximity switch 20 are accumulated in the microprocessor and may be multiplied by a corrective factor hereinafter described to obtain a precise length of the sheet. The length is stored in the microprocessor. Thus the length of a sheet is known as well as the time for the sheet to arrive at a discharge point from the sensors 14 which is a fixed distance.

As will be noted from FIG. 1; the ironing cylinder 14 rotates clockwise and with the assistance of roll 22 and guide tapes or ribbons 24 which rotate about roll 26, flatwork is maintained in contact with the outer periphery of the rotating ironing cylinder 14 prior to being discharged adjacent guide fingers 30 which assist in guiding the leading edge of a sheet or the like onto the upper surface of a conveyor 32. The latter comprises continuous ribbons or tapes 34 rotatable about spaced roll 36 and 38 as is most clearly seen in FIG. 2 of the drawing.

It will be more clearly seen from FIG. 1 of the drawing that an air bar 40 is appropriately positioned adjacent roll 27 engaging the continuous tapes 24 which engage the flatwork in the course of movement about the outer periphery of the ironing cylinder 14. Accordingly, upon discharge at the point between the cylinder 14 and conveyor 32 at the vicinity of roll 27, air bar 40 is actuated by the microprocessor through a solenoid (not illustrated) to emit a short air blast for driving the initial end of the flatwork item being processed onto the underlying guide fingers 30, onto upper surface of conveyor 32 and the upper runs of the tapes 34 moving to the right as indicated by the arrows in FIG. 2. The bar 40 may be secured to the ends of guide fingers 30 which are pivotally mounted for adjustable positioning.

Prior to leaving conveyor 32, flatwork is sensed by photosensors 68 one of which is seen in FIG. 1 and both being seen in FIG. 6. The length of the item is retrieved from the microprocessor, and speed sensor 70 (See FIG. 3) rotatably engaging the flatwork leaving conveyor 32 measures the article speed. Motor 73 (FIG. 1) is energized to swing folding arm 44 disposed beneath the discharging flatwork from conveyor 32 by signals from the microprocessor of microcontroller board P of FIG. 15 in accordance with the desired transverse folds to be made on the dropping flatwork. Equivalent means such as a pneumatic piston-cylinder unit may obviously be substituted for Motor 73 to actuate arm 44.

Figure 7:
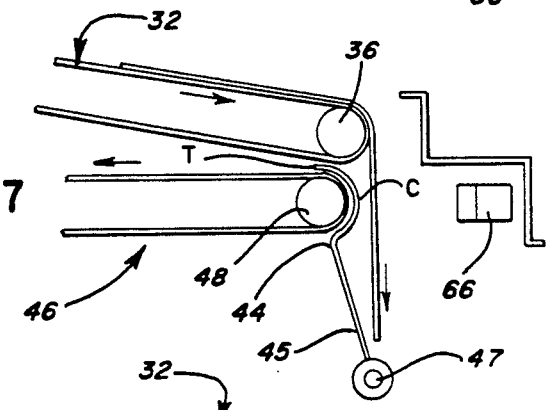
FIGS. 7–9 are schematic views illustrating the sequence of movements of a fold-forming retainer-stuffer arm at a primary folding station employed in the ironer-folder of this invention.
Figure 8:
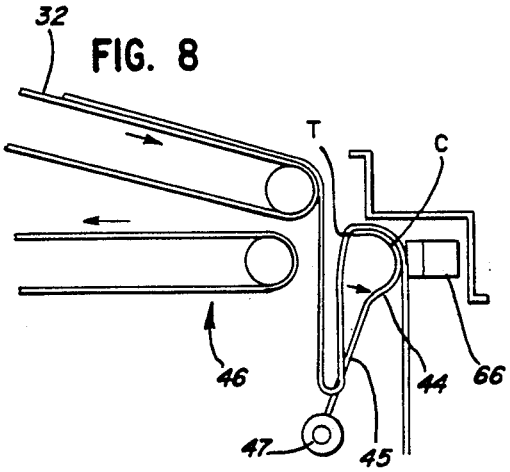
Figure 9:
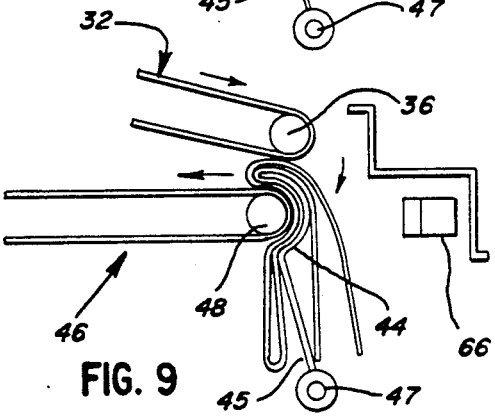

Accordingly, a sheet or the like upon moving to the right end of conveyor 32 over roll 36, falls by gravity on the inside of protective fingers 42 (FIG. 1) whereby flatwork such as sheet S of FIG. 4 may be transversely folded by way of example, into approximately quarter-length panels in accordance with a preferred sequence of folding operations illustrated in FIGS. 7–9.

It will be noted from FIG. 7 that swinging arm 44 is of substantially C-shaped cross-section and swings or pivots about axis 47 by means of spaced supports 45 disposed at opposed arm ends. One support 45 is seen in FIG. 2. Arm 44 is disposed to the left in FIG. 7 with its terminal distal edge 'T' located beneath bottom runs of continuous tapes 34 of upper conveyor 32. Edge T is received above continuous tapes 34 of underlying conveyor 46 more clearly seen in FIG. 2 of the drawing. The tapes 34 of a lower conveyor 46 have the upper runs thereof moving to the left and have the bottom runs thereof moving to the right as illustrated by arrows in FIG. 2. It will also be noted that tapes 34 of lower conveyor 46 move about opposed rolls 48 and 50.

The drive means for the ironing cylinder 14, as well as the tapes 24 employed in conjunction with the ironing cylinder and drive roll 36 of conveyor 32, and drive roll 48 of conveyor 46 is more clearly seen from the diagrammatic view of FIG. 3. It will noted from the latter figure that main variable-frequency drive motor M rotatably drives cylinder 14 through belt or chain 54 engaging output sprocket 37 of speed reducer R. The output shaft on which sprocket 37 is mounted rotates continuously whereby the cylinder continuously is in a condition for receiving flatwork to be ironed.

Sprocket 37 also engages chain 39 engaging drive roller 36, see FIG. 2 of upper conveyor 32 for purposes of moving the conveyor to the right as indicated by the arrows in FIGS. 3 and 2, and also engages a sprocket (not illustrated) mounted on drive roll 48 of lower conveyor 46 so as to drive the upper runs of the latter conveyor to the left as indicated by the arrows of FIGS. 2 and 3. The latter sprocket may be disconnected from drive engagement with roller 48 by brake-clutch assembly 71 illustrated in phantom line in FIG. 3 which is adapted to promptly stop movement of conveyor 46 and disengage the drive sprocket from roller 48 upon an output signal from microcontroller board P. It will be noted from FIG. 3 that drive chain 39 also engages idler sprocket 62.

Referring once again to FIG. 7, it will be noted that in accordance with a preferred folding sequence, after approximately 23% of the length of the sheet S dropping from the upper end of conveyor 32 has draped behind the upper end of the C-shaped arm 44, the arm is moved to a retaining position against anvil bar 66 in which the arm convex surface 'C' opposite terminal edge 'T' retains the flatwork leading panel against anvil 66. Thereafter approximately 54% of the length of sheet S is allowed to drape between the retaining arm 44 and the conveyors in the form of two central panels as shown in FIG. 8. The arm 44 is then moved to the left as illustrated in FIG. 9. Following such movement the terminal 23% of the sheet drapes over the partially-folded sheet as the bight of the transversely folded sheet is fed or stuffed between the counter-rotating rolls 36 and 48 and also lower runs of upper conveyor 32 and the upper runs of lower conveyor 46 all moving to the left in FIG. 9. It will also be seen from FIG. 9 that the upper conveyor 32 is inclined downwardly at a slight angle to lower conveyor 46, the tapes of which are substantially horizontally disposed to assure mutual gripping action of the folded sheet by the upper conveyor. It is thus seen that swinging C-shaped arm 44 has a combination sheet retaining-stuffing function as it forms four sheet panels by simply swinging once to the right and once to the left.

It should be noted that the two photosensors 18, only one of which is illustrated in FIG. 1, are transversely aligned parallel to the axis of rotation of the ironer cylinder 14 and accordingly any transverse deviation of the leading edge of the flatwork piece to be processed is evidenced by a time differential sensed by the spaced sensors 18 which may be conveyed to the microcontroller board P as indicated in the block diagram of FIG. 15 so that the pivotal action of the folding arm 44 may be adjusted to compensate for the difference in edge disposition. Such compensation may comprise length measurement (i.e., pulse accumulation) during the interval between covering of the first-engaged, sensor and uncovering of the sensor last in engagement with the flatwork. Thus the swinging movement of the arm 44 will adjust for the variance in the transverse disposition of the leading edge of the sheet being processed by the increased length measurement.

Although the proximity switch 20 senses the speed of rotation of the cylinder 14, such speed of rotation may not be precisely translated into the speed of movement of a sheet or the like being driven by the various tapes 24 and drive rollers engaging such tapes. Accordingly, to insure precise actuation of folder arm 44 and resulting desired precise panel width, output photosensors 68 and encoder or speed sensor 70 sense the sheet S in the course of being discharged from the upper surface of conveyor 32. Sensors 68 (FIGS. 1 and 6) located adjacent arm 44 provide input signals to a microprocessor, such as Intel Model 8751 which may be mounted in P, to commence pivotal movement of the arm 44 to divide the sheet as desired in accordance with the known sheet length stored in P.

After the entire length of the sheet has engaged encoder 70, this sheet length is compared with the sheet length as measured by the sensor eyes 18. If there is a differential, a corrective factor is employed to correspondingly adjust the lengths to be stored in P.

For more precise fold formation, the arm timing may be advanced to compensate for material speed entering the primary folding station illustrated in FIGS. 7–9.

Arm actuation is carried out by its own motor 73 of FIG. 1. During the pivotal movement of shaft 47 to the left as illustrated in FIG. 9, both upper and lower conveyors 42 and 46 respectively are moving so that the folded sheet is driven to the left beneath the ironing cylinder 14 on the upper surface of conveyor 46. FIG. 6 is a plan view of the transversely folded sheet S2 in phantom outline after the same has been folded into approximate quarters. FIG. 6 illustrates the photosensors 68 which are located between the runs of upper conveyor 32 and above lower conveyor 46, sensors 68 being illustrated in alignment in side elevation in FIG. 1. These two sensors are spaced apart for example approximately 34 inches and they detect and measure the length of each flatwork piece prior to dropping from the edge of upper conveyor 32. Signals from the senors actuate folding blade motor 73 as the desired length percentages are played out from the micro-processor memory.

FIG. 6 also indicates the location of photosensors 72 and 74 which are located between the upper and lower runs of the conveyor 46 and in conjunction with photosensor 76 determine whether the edges of the transversely folded sheet in Form S2 are in proper disposition when sheet S2 is momentarily stopped, relative to underlying, flatwork-folding pinch rolls 80 which are also located between the runs of the conveyor 46. If any of sensors 76, 72 or 74 is covered by sheet S2, such would evidence an improper sheet location for being folded by the pinch rolls 80, as a sheet portion would not be disposed over the bite of the rolls and inefficient folding or jamming could result as a consequence. Accordingly, if activated, photosensor 78 (see FIG. 16) is covered, and photosensors 72, 74 and 76 are uncovered, an energizing input signal to elements of the circuit of FIG. 16 is effected as follows, indicating that the sheet is in proper position.

It is the function of photosensor 78, upon sensing the leading edge of the sheet S2, to actuate the clutch and brake unit 71 (schematically illustrated in FIG. 3. The drive for drive rolls 48 is then disengaged and a brake applied to roll 48 to promptly stop travel of conveyor 46. Unit 71 is energized through a triggering monostable circuit 136 as seen in FIG. 16. After a short time delay to insure that the sheet is completely at rest, the coil of solenoid valve 84 is energized so that a downwardly directed air blast may be emitted from the air bar 82, in the manner illustrated in FIGS. 11 and 12. The blast forces the midpoint of the stationary sheet S2 between the counter-rotating pinch rolls 80 driven by means of motor-speed reducer unit 86 illustrated in FIG. 11. As a result of such air blast, the sheet S2 is cross-folded, driven downwardly between the rolls over conveyor ribbons 89 engaging a pinch roll 80 and deposited on the upper ribbon runs of conveyor 88.

FIG. 16 illustrates circuitry for controlling the first cross fold operation. The overwidth photosensors 72, 74 and 76 are connected to inputs of an OR gate 130, the output of which is applied to a disable input of a monostable circuit 132, the output of which is connected to the driver for the solenoid 84 of the first cross-folding air bar 82. The input of the monostable circuit 132 is connected to an output of a delay circuit 134, the input of which is connected to the output of the activate photosensor 78. A second monostable circuit 136 has an input connected to the output of the photosensor 78 and has outputs connected to the clutch and brake 71 for roll 48 driving the second conveyor 46.

Each of the circuits of FIGS. 16–18 may be implemented by using a microprocessor which may be the same microprocessor as used in the microcontroller board P of FIG. 15 controlling the primary fold effected by blade 44.

The upper runs of conveyor 88 move to the left as indicated by the arrow in FIGS. 2 and 11. Conveyor 88 is transversely disposed to overlying conveyors 32 and 46 as is more clearly seen from FIG. 2 in which continuous ribbons 34 of the third conveyor are fragmentarily illustrated. The upper runs of conveyor 88 move to the side of the ironer-folder 10 illustrated in FIG. 1.

Figure 14:
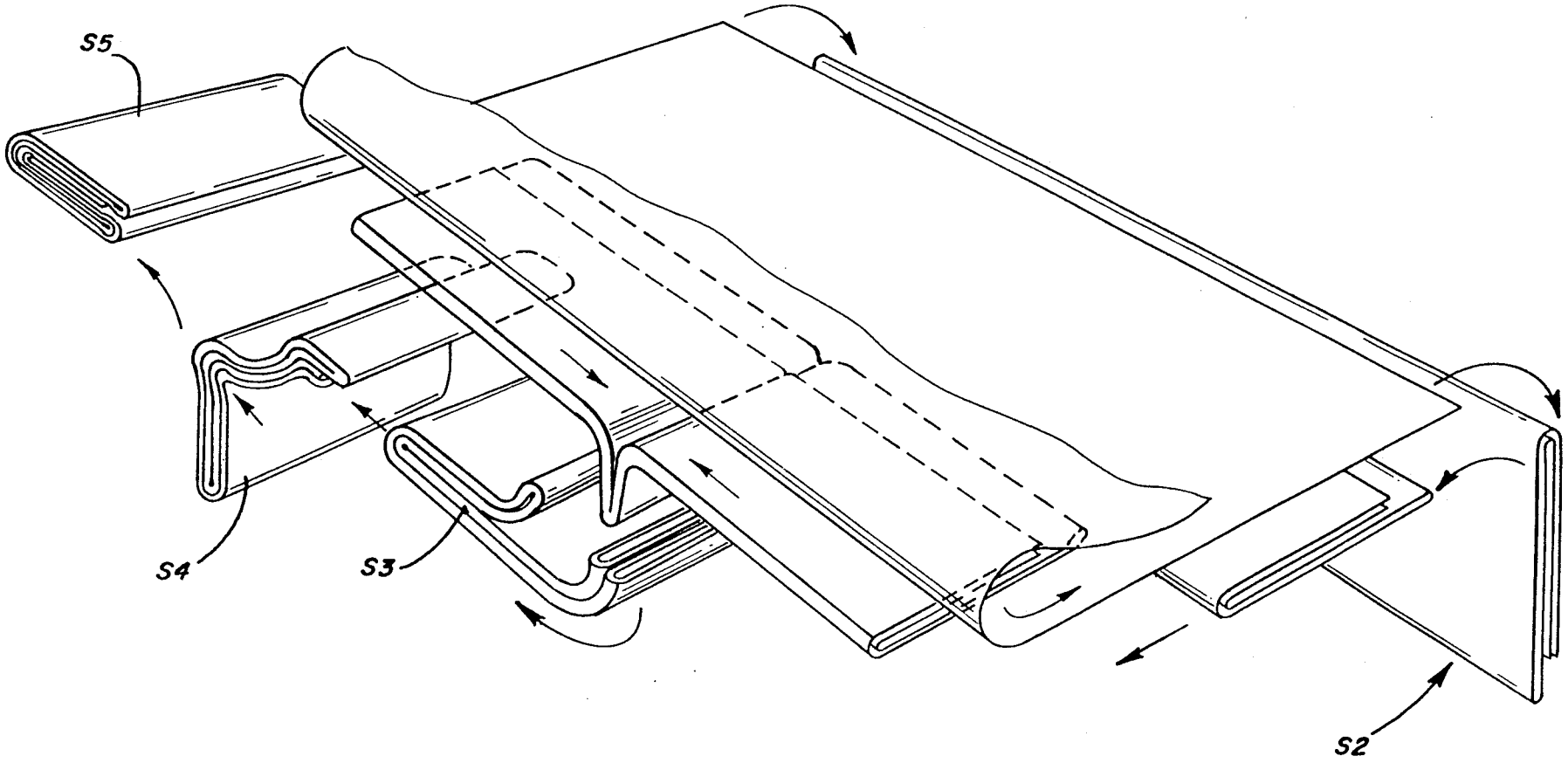
FIG. 14 is a schematic perspective view illustrating the sequence of folding steps taking place on folded flatwork passing from the folding arm at the primary folding station in the course of progressing to the ironer-folder exterior.

It will also be noted from FIG. 11 that tapes 34 of conveyor 46 may slidably move over a slotted plate 90 having a central opening 92 disposed over the bite of underlying pinch rolls 80. Following passage between the pinch rolls 80 the sheet S2 will have the configuration S3 illustrated in FIG. 14 as the same as driven downwardly onto the underlying conveyor 88. As the sheet in the form of sheet S3 in FIG. 14 is moves to the left as illustrated in FIG. 12 it is sensed by photosensor 94 after which a clamp plate 96, upwardly movable about pivot axis 98 is actuated to clamp the leading edge of the sheet in the form of sheet S3 of FIG. 14 against an overlying stationary clamp bar 100 in the manner illustrated in FIG. 12.

Photosensor 94 actuates the pivotally mounted clamp plate 96, after a slight time delay so that approximately the leading 2 inches of the travelling sheet in the form of S3 is clamped against the stationary bar 100. Plate 96 may be actuated by a solenoid-controlled pneumatic piston and cylinder unit or the like (not illustrated).

Following passage of the terminal end of the sheet in the form of S3 from photosensor 94, the clamp plate 96 in the position of FIG. 12 is actuated to move into the position of FIG. 11 so as to drop the leading edge of the sheet bight end in the form of S3 so that the same will overlie the terminal edge. The resulting sheet configuration S4 is illustrated in FIG. 14 with the original sheet extending slightly beyond the free terminal sheet ends on the bottom. The sheet form S4 then proceeds to the left terminal end of conveyor 88.

FIG. 17 shows circuitry for controlling this folding operation on conveyor 88. The fold photosensor 94 develops an output signal which is applied to two delay circuits 138 and 140. Delay circuit 138 is arranged to respond to the leading edge of a sheet by way of the signal developed by the photosensor 94, and circuit 140 is responsive to the trailing edge of the sheet leaving photosensor 94. The output of delay circuit 138 is applied to an enable input of clamp-blade controller 139 while the output of delay circuit 140 is applied to a disable input of the controller 139 which may be a solenoid controlling actuation of plate 96.

Thus, when the leading sheet edge is detected, the controller 139 is energized after a short delay, controlled by the delay circuit 138, to pinch the sheet leading edge against the bar 100. The delay may be adjusted, as through an adjustable resistor 141 as shown so that about two inches of material is pinched, for example. The material then rolls on itself as shown in FIG. 14 and when the trailing edge of the sheet passes the photosensor 94, the delay circuit 148 is activated to disable the controller 139 and drop the clamp plate 94. The delay circuit 140 is also adjustable, as through a resistor 141 and when properly adjusted, the leading edge is dropped onto the trailing edge so that they are approximately even, thus folding the material in half.

Prior to arriving at such terminal end of conveyor 88 the leading edge of the sheet S4 is sensed by the photosensors 102 and 104. If the piece in the folded condition is short enough as not to cover sensors 102 and 104 simultaneously, the length of the moving piece is determined by sensor 104 entirely. Then on the mid-point of the sheet S4 being appropriately located relative to air bar 106 while dropping from the end of conveyor 88, an output signal originating with sensor 104 energizes solenoid 108 so that the air blast is exerted against the midpoint of sheet S4 as illustrated in FIG. 12 so as to drive the same between the lower runs of continuous tapes defining an upper conveyor 110 and upper runs of the tapes defining a lower conveyor 112 of FIG. 12. The runs move in the direction of the arrows so as to drive the folded sheet in the condition of sheet of S5 to the exterior of the ironer-folder onto a shelf 114. Motor and speed reducer unit 116 drive a chain 118 engaging sprockets on drive rollers of the two conveyors 110 and 112 as schematically illustrated in FIG. 11.

Sheet S4 may have the major portion thereof depend from the terminal end of conveyor 88 without dropping therefrom as a result of the resilient retention or clamping effect of undriven "conveyor" 120 having continuous tapes movable about opposed rollers 122 and 123, the latter being spring loaded by spring 125, see FIGS. 11, 12 and B clamp conveyor. 120 retains the terminal end of the sheet S4 in engagement with conveyor 88 until air bar 106 has driven and folded sheet S4 between the conveyors 110 and 112. Clamp conveyor 120 and conveyor 88 define a receiving throat 127 into which flatwork is driven by the tapes of conveyor 88.

If it is desired to bypass the final cross-fold effected by air bar 106 in conjunction with discharge conveyors 110 and 112, a bypass switch is tripped and an input signal from the sensor 104 will actuate solenoid 108 to emit an air blast through air bar 106 whereby the leading edge of the sheet S4 is driven between the discharge conveyors 110 and 112 in the manner illustrated in FIG. 13. Accordingly, the sheet will be discharged from the ironer-folder in the form S4.

In the event, the sheet S4 is long enough to cover both photosensors 102 and 104. The length of the sheet S4 is determined by the time interval commencing when the sheet S4 initially covers sensor 104 and terminating when the sheet S4 leaves engagement with the sensor 102. As the interval between the sensors 102 and 104 is fixed, the "length" is readily ascertained.

FIG. 18 illustrates circuitry for controlling the third crossfold operations. As shown, the photosensor 104 has an output connected to an enable input of a divide-by-two circuit 151 which receives clock pulses from an oscillator 153. Oscillator 153 is arranged to develop a certain number of counts per inch of travel of the sheet. An output of the divide-by-two circuit 151 and the output of the oscillator 153 are connected to inputs of a NOR gate 155, the output of which is applied to one input of an OR gate 156 which forms a count accumulator gate.

A second input of the OR gate 156 is connected to the output of an NOR gate 160, one input of which is connected to the output of the photosensor 104, as shown. The output of the OR gate 156 is applied to a count accumulator 159 which may for example, have a capacity of 256 counts and which develops an output signal at a line 158 when the count is full. The output signal on line 158 is applied to a second input of the NOR gate 160 and is applied through a delay circuit 162 to a driver 164 for the solenoid 108.

In operation, when the flatwork covers the third conveyor crossfold photosensor 104, the divide-by-two circuit 151 is enabled and the count accumulator gate 156 is opened. While the photosensor is covered, LZ/2 counts are accumulated. When the trailing edge of the sheet passes the sensor 104, it turns off and disables the divide-by-two circuit 152 so the accumulator will now input at the higher count rate of Z.

To determine how many more inches the material will travel before the air blast the following formula may be used:

$$(256-LZ/2)/Z+D$$

256−L/S represents the counts needed to fill accumulator (157)

1/Z represents the inches traveled per count

D represents the delay in inches from full accumulator to air blast

To determine the distance from its trailing edge where the material is folded use the formula:

$$X=A-256/Z+L/2-D$$

If the material is to be folded in half regardless of size, then X=L/2.

Then is follows that:

$$X = L/2 - A - 256/Z + L/2 - D$$
$$A = 256/Z - D = 0$$
$$D = A - 256/Z$$

Again it follows that if the delay is set to equal A−256/Z, all lengths of material will be folded in half.

A=distance from photosensor to air blast

D=delay distance from accumulator full to air blast

Z=oscillator rate in counts per inch of travel

L=length of linen

X=distance from linen railing edge where folded

It is noted that the conveyor and material speed is substantially constant (180 feet/minute). Variable speed may be provided for by adjusting the oscillator rate in proportion to the conveyor and material speed.

It may be desirable, as when the sheet has a very short length, to by-pass the final cross-folding operation and to feed the leading edge of the sheet directly between the belts 110 and 112. For this purpose a manual switch 168 may be provided to disable the circuit of FIG. 18 and enable the circuit of FIG. 19. In the latter circuit, the photosensor 104 triggers a first monostable circuit 163 having an adjustable timer which is adjusted to time out just before the sheet leading edge is in front of the air bar 106. When the first monostable circuit times out, it activates a second monostable circuit 164 having an adjustable timer which is adjusted to remain on until the leading edge of the sheet is transferred onto the conveyor tapes 112. The air bar 106 is activated while the second monostable circuit is activated.

Is thus seen that the provided ironer-folder is able to efficiently perform a number of folding operations in a limited amount of space that is no greater than that occupied by an ironer alone of comparable size to the ironer element of the apparatus described above. The transverse folding into approximate quarters effected by the swinging arm 44, results in a transversely folded sheet folded in a "classic" manner, that is, the manner in which two individuals engaging opposed longitudinal ends of a sheet with normally fold a sheet.

Figure 10:
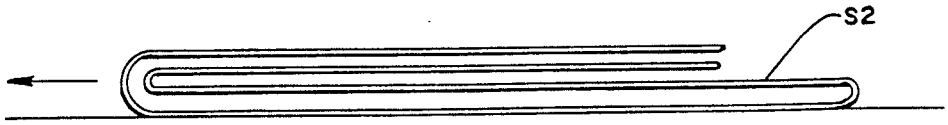
FIG. 10 is a schematic side elevational view of an item of flatwork following processing in the three folding steps of FIGS. 7–9.

It will further be noted from the various views of the drawing, that by virtue of the particular fraction of the sheet length engaged by the pivotal retainer-stuffer arm 44 that the free end panels of the sheet S2 are narrower than the remaining approximate quarters of the sheet joined by a continuous bight as clearly seen in the side view of FIG. 10 of the drawing. As a result, the final sheet S5 illustrated in FIG. 14 and FIG. 5 will have both the free or selvage longitudinal and lateral terminal edges disposed within the sheet interior. That is such selvage edges are hidden within the finished sheet package between sheet portions having continuous bights defining the opposed lateral end portions as is most evident from FIG. 5 of the drawing. As the selvage edges are all disposed within the final folded sheet interior, the finished sheet package is seen to be both precisely folded and eye-pleasing.

The automatic folding sequences made possible by means of a microprocessor, the circuits and the sensing elements described above enable the sheet folding operations to be carried out automatically without any operator intervention or a necessity for adjustment of the apparatus on change in sheet size. The various sensing elements automatically sense speed of the apparatus, speed of the flatwork passing therethrough as well as the length of flatwork passing therethrough whereby the folding operations may be carried out at the precise times desired for purposes of effecting the desired precise fold.

The automatic apparatus also enables the speed of the ironer-folder to be extremely fast so as to result in high production. The provided high productivity is extremely advantageous in installations such as hotels which quite often are located on costly realty which necessitates that optimum use be made of space allocated for apparatus of the type described above. By way of example, the speed of the sheets is anywhere within the broad range of 20 to 105 feet per minute in the course of preceding through the apparatus to the first cross-fold station over counter-rotating pinch rolls 80. This is due in large part to the single two-swing action of the arm 44 supported between spaced supports 45. The sheet portions depending from the upper clamped portions are allowed to hang vertically without bunching or wrinkling between supports 45 as is most evidence from FIG. 8. The short swings of arm 44 are effected substantially instantaneously.

The flatwork proceeding on the conveyors beneath the cross-folding pinch rolls may be processed at a speed of as high as 180 feet per minute. It will noted from the foregoing description that despite the plurality of stations present, the number of moving parts are at a minimum with resultant durability of apparatus and desired long apparatus life. It is believed apparent that the folds effected by the reciprocating retainer-stuffer arm 44 may be varied by altering the sequence and timing of the movement of the arm with the final arm swing only, stuffing the folded and supported sheet between counter-rotating rolls 36, 48.

Similarly, it is believed apparent that subsequent folding stations may be bypassed as desired by inactivating the various folding elements defining each cross-folding station. Thus a sheet folded by the arm 44 in the primary folding station may be conveyed by conveyor 32 after being transversely folded along its length to the feed side of the apparatus for stacking or hand-folding by the operators.

Small pieces such as napkins and the like may be fed in a plurality of spaced lanes simultaneously for return to the front of the apparatus following ironing, by conveyor 46. Such return is facilitated by guide fingers 30 of FIG. 1 which may be pivoted to substantially the vertical plane and air bar 40 secured thereto is similarly pivoted. As a result, napkins and similar small laundry pieces drop into underlying conveyor 46 for movement into shelf 75. With such small pieces, all folding stations are bypassed.

The sensors provided in the above described apparatus assure desired disposition of the sheet in its various folded forms and as a result, precise folding of the sheets in a sequence of folding, with resultant avoidance of any jamming or poorly-folded sheets.

It is believed apparent to those skilled in the art that modifications may be made in the apparatus above described, which modifications remain within the ambit of the invention disclosed. Thus, the ironer element of the above-described element although a rotary cylinder may be of another type such as a chest-type and remain within the scope of the invention disclosed if element relationships are as hereinafter claimed.

This invention is to be limited therefore only by the scope of the appended claims.

What is claimed is:

1. An ironer-folder comprising an ironing surface for ironing flatwork; conveyor means for conveying such flatwork into engagement with said ironing surface, and discharging the ironed flatwork onto a first feed conveyor having opposed terminal ends, moving along on axis of movement and disposed beneath said ironing surface; a swinging arm movable away from and toward said first feed conveyor and so disposed at one terminal end of said first feed conveyor whereby flatwork discharged from said one terminal end of said first feed conveyor is folded into sections transversely to the flatwork axis of movement on said first feed conveyor; a second feed conveyor disposed beneath said first feed conveyor and moving in a direction opposite to the direction of movement of said first conveyor whereby movement of said swinging arm toward said first feed conveyor places the folded piece of flatwork onto said second conveyor for movement of the folded flatwork beneath said ironing surface; said second feed conveyor having a longitudinal opening disposed parallel to said second conveyor direction of movement; counter-rotating pinch rolls disposed beneath said opening; means for stopping said second feed conveyor when the folded flatwork disposed thereon is located over said pinch rolls and forcing the portion of the folded flatwork over the pinch rolls therebetween whereby the folded flatwork is cross-folded and removed from said second feed conveyor; a third conveyor having opposed terminal ends and a direction of movement substantially transverse to that of said second feed conveyor located beneath said first and second feed conveyors and beneath said ironing surface for receiving the cross-folded flatwork items discharged from said pinch rolls; and means for discharging flatwork to the exterior of said ironer-folder comprising overlying conveyors of continuous tapes moving about spaced rolls and having adjacent tape runs extending from adjacent one terminal end of said third conveyor to adjacent the ironer-folder exterior; said overlying conveyors of the flatwork discharging means being located beneath said ironing surface; and means for forcing a desired transverse portion of the folded flatwork dropping from said one terminal end of said third conveyor between the adjacent tape runs of the flatwork discharging means while a portion of the flatwork remains on said third conveyor whereby such folded flatwork is engaged by said flatwork discharging means prior to being discharged to the ironer-folder exterior.

2. An ironer-folder comprising an ironing surface for ironing flatwork; conveyor means for conveying such flatwork into engagement with said ironing surface, and discharging the ironed flatwork onto a first feed conveyor having opposed terminal ends, moving along an axis of movement and disposed beneath said ironing surface; a swinging arm movable away from and toward said first feed conveyor and so disposed at one terminal end of said first feed conveyor whereby flatwork discharged from said one terminal end of said first feed conveyor is folded into sections transversely to the flatwork axis of movement on said first feed conveyor; a second feed conveyor disposed beneath said first feed conveyor and moving in a direction opposite to the direction of movement of said first conveyor whereby movement of said swinging arm toward said first feed conveyor places the folded piece of flatwork onto said second conveyor for movement of the folded flatwork beneath said ironing surface; said second feed conveyor having a longitudinal opening disposed parallel to said second conveyor direction of movement; counter-rotating pinch rolls disposed beneath said opening; means for stopping said second feed conveyor when the folded flatwork disposed thereon is located over said pinch rolls and forcing the portion of the folded flatwork over the pinch rolls therebetween whereby the folded flatwork is cross-folded and removed from said second feed conveyor; a third conveyor having opposed terminal ends and a direction of movement substantially transverse to that of said second feed conveyor located beneath said first and second feed conveyors and beneath said ironing surface for receiving the cross-folded flatwork items discharged from said pinch rolls; means for folding flatwork having spaced leading and trailing edges, while moving on said third conveyor between the pinch rolls and said third conveyor one terminal end; said folding means including a transverse bar overlying said third conveyor and a reciprocally movable clamp for engaging such leading edge of the flatwork moving on said third conveyor and clamping such edge to the transverse bar, means for releasing such leading edge from between the clamp and bar while such flatwork is moving on said third conveyor whereby such leading edge drops on substantially the flatwork trailing edge; means for discharging flatwork to the exterior of said ironer-folder comprising overlying conveyors of continuous tapes moving about spaced rolls and having adjacent tape runs extending from adjacent one terminal end of said third conveyor to adjacent the ironer-folder exterior; said overlying conveyors of the flatwork discharging means being located beneath said ironing surface, and means for forcing a desired transverse portion of the folded flatwork dropping from said one terminal end of said third conveyor between the adjacent tape runs of the discharging means while a portion of the flatwork remains on said third conveyor prior to such folded flatwork being discharged to the ironer-folder exterior.

3. The ironer-folder of claim 2 in combination with means sensitive to the movement of flatwork on said third conveyor in operative communication with said means for folding whereby said reciprocally movable clamp is actuated at appropriate intervals to form a flatwork fold.

4. The ironer-folder of claim 2 in combination with spaced apart means sensitive to movement of flatwork on said third conveyor between said cross-folding means and the end of said third conveyor in operative communication with the means for forcing folded flatwork dropping from the third conveyor onto the conveyors of the flatwork discharging means.

5. The ironer-folder of claim 2 wherein said first and second feed conveyors comprise spaced continuous tapes movable between tape-engaging rolls disposed at opposed conveyor ends; two tape-engaging rolls of said first and second conveyors being so located relative to said swinging arm that movement of the arm towards the first feed conveyor forces folded flatwork disposed on said arm into the bite of said two tape-engaging rolls.

6. The ironer-folder of claim 5 wherein said swinging arm is of substantially C-shaped sectional configuration and connected at opposed longitudinal end portions to spaced supports connecting said arm to a pivot axis.

7. The ironer-folder of claim 5 wherein said swinging arm has a curved cross-section having a terminal edge receivable in said roll bite to facilitate initial roll-flatwork engagement.

8. The ironer-folder of claim 7 in combination with means for sensing the passage of the leading edge of folded flatwork onto the second feed conveyor for assuring proper flatwork disposition relative to the longitudinal opening of said second feed conveyor.

9. The ironer-folder of claim 2 in combination with means for stopping the second conveyor upon arrival of a flatwork article thereon at a predetermined position relative to said pinch rolls; means sensitive to the location of the leading and trailing edges of flatwork relative to the pinch rolls while on the second feed conveyor while the second fed conveyor is stopped; said latter means being in operative communication with the means for forcing flatwork between the pinch rolls.

10. The ironer-folder of claim 2 in combination with means for securing the portion of flatwork remaining on the third conveyor to said third conveyor while such flatwork is dropping from said third conveyor until the flatwork is also in engagement with the means for discharging flatwork.

11. The ironer-folder of claim 1 or 2 wherein said ironing surface is that of a rotatable ironing roll and is in combination with means for sensing the movements of such flatwork onto the ironing roll and measuring the length thereof; means for sensing the speed of rotation of the ironing roll whereby the speed of passage of each flatwork piece when arriving at said swinging arm is determined; and control means sensitive to the length of each flatwork piece and the presence of flatwork prior to dropping onto said swinging arm from said first conveyor for pivotally actuating the swinging arm so as to divide such flatwork piece into sections of desired width upon discharge from said first feed conveyor onto said arm.

12. An ironer-folder comprising an ironing roll rotatable about an axis of rotation; a retainer-stuffing arm having a pivot axis of movement substantially parallel to the roll axis of rotation; first conveyor means for guiding flatwork to be ironed into engagement with said ironing roll while rotating and conveying ironed flatwork onto said arm whereby such ironed flatwork is transversely folded substantially into quarters; such transversely folded flatwork having longitudinal free edges disposed in overlying relation; second conveyor means comprising spaced continuous tapes for removing such transversely folded flatwork from said arm in one position of arm pivotal movement and conveying such folded flatwork beneath said ironing roll; means for stopping said second conveyor means and for removing and simultaneously cross-folding such folded flatwork disposed on said second conveyor means; third conveyor means disposed beneath said second conveyor means and moving at substantially right angels to said second conveyor means beneath the ironing roll for conveying flatwork conveyed thereon toward the ironer-folder exterior; the cross-folded flatwork being driven between tapes of said second conveyor means onto said third conveyor means whereby the folded flatwork is cross-folded; and second and third folding stations beneath the ironing roll for additional folding of the flatwork while moving toward the ironer-folder exterior beneath said ironing roll.

13. A laundry flatwork folding station comprising first conveyor means for moving foldable flatwork along an axis of movement; means for sensing a length of foldable flatwork while moving on said first conveyor means; flexible movable belt means disposed at an end of said first conveyor means resiliently engaging said first conveyor means and angularly disposed to said first conveyor means so as to define a throat with said first conveyor means end through which flatwork leaving said conveyor means end passes and is compressed prior to dropping from the conveyor means; second conveyor means disposed adjacent said first conveyor means end; means oppositely disposed to said second conveyor means for urging a desired transverse segment of flatwork dropping from said end of said first conveyor means onto said second conveyor means.

14. The folding station of claim 13 wherein said second conveyor means comprises overlying continuous tapes moving in opposite directions; the bottom tape runs of a top conveyor and a top tape runs of a bottom conveyor moving in the same direction; the means for urging comprising air bar means for forcing a transverse segment of flatwork between said bottom and top tape runs.

15. The folding station of claim 13 wherein the means for sensing the length of foldable flatwork is in operative communication with the urging means whereby a desired transverse segment of flatwork dropping from the first conveyor means is urged onto said second conveyor means.

16. The folding station of claim 15 in combination with control means responsive to said means for sensing, in operative communication with said means for urging; said control means including delay means for energizing said means for urging.

17. A combination ironer-folder comprising a ironing means for ironing flatwork and discharging ironed flatwork onto a first conveyor; a pivoting arm disposed at one end said first conveyor for effecting a plurality of transverse folds on ironed flatwork dropping from said one end of said conveyor; a second conveyor of continuous tapes and underlying said first conveyor for receiving transversely folded flatwork from said pivoting arm during pivoting movement of said blade toward said first and second conveyors; counter-rotating pinch rolls disposed beneath said second conveyor; means for stopping said second conveyor when flatwork thereon in predeterminately located relative to said pinch rolls; means for urging flatwork on the second conveyor between tapes thereof into the pinch rolls for cross-folding such flatwork; a continuously-moving third conveyor moving at a substantially constant speed disposed beneath said second conveyor for conveying cross-folded flatwork toward one ironer-folder side and terminating in spaced relation with such side; means for cross-folding flatwork while moving toward such ironer-folder side including a fourth conveyor comprising overlying tape runs moving in the direction of said side disposed adjacent the terminal end of said second conveyor; and means for urging a desired transverse segment of flatwork dropping from said third conveyor between said overlying tape runs.

18. A laundry flatwork folding station comprising an upper laundry conveyor for moving laundry flatwork along a first axis of movement; said upper conveyor being formed of continuous tapes movable about spaced rolls; an underlying conveyor for moving laundry flatwork along a second axis of movement substantially opposite to said first axis of movement, and formed of continuous tapes movable about spaced rolls; the tape engaging rolls defining the end of said upper conveyor and the beginning of said underlying conveyor defining counter-rotating pinch rolls; an anvil bar oppositely disposed in spaced relation with the roll of said underlying conveyor defining said pinch rolls; a swinging retainer-stuffer arm of substantially C-shaped sectional configuration having a terminal edge receivable in the bite of said counter-rotating pinch rolls at one end limit of movement and having a convex surface portion oppositely disposed to said terminal edge adapted to engage said anvil bar at a second end limit of arm movement; said swinging arm being so supported whereby swinging movement is imparted to said retainer-stuffer arm without interfering with the disposition of flatwork portions supported thereby and hanging in the vertical plane.

19. The folding station of claim 18 wherein support arms engage end portions of said arm and are pivotally movable about an axis substantially parallel to the axes of rotation of said pinch rolls and are in further combination with first means for sensing the length of flatwork in the course of proceeding to said folding station; second means for sensing the presence of flatwork just prior to leaving said upper conveyor, and third means for swinging said retainer-stuffer arm sequentially into a flatwork-retaining position against said anvil bar and into a flatwork stuffing position with the terminal arm edge disposed within the bite of said pinch rolls.

20. The folding station of claim 19 in which flatwork engaged by said retainer-stuffer arm hangs freely in a vertical plane between said arm supports.

21. A method for processing flatwork comprising the steps of moving ironed flatwork from an ironing roll along an axis of movement; transversely folding said flatwork into panels of desired width with the longitudinal terminal ends of the flatwork in substantially superposed relation, conveying the transversely folded flatwork along a second axis of movement with the flatwork longitudinal terminal ends uppermost; bringing the transversely folded flatwork to a stop; driving the transversely folded flatwork at a lateral central flatwork axis downwardly between counter-relating pinch rolls so as to cross-fold the folded flatwork with the free longitudinal terminal ends thereof disposed interiorly of the resulting cross-folded flatwork and with opposed lateral terminal ends of the cross-folded flatwork in overlying relation defining a trailing flatwork end oppositely disposed to a leading flatwork end defining a flatwork bight portion; further-folding the flatwork by dropping the leading bight portion of the once cross-folded flatwork substantially on the trailing end of such flatwork while moving along a third axis of movement whereby the flatwork is folded with the flatwork lateral terminal ends defining the bottom of flatwork; and cross-folding the flatwork by urging the middle of the bottom of the flatwork along an axis parallel to the flatwork bight portion between counter-rotating pinch rolls to cross-fold the flatwork with the lateral terminal free edges of the flatwork disposed interiorly of the flatwork whereby all selvage edges are interiorly disposed in the final finished sheet package.

* * * * *

UNITED STATES PATENT AND TRADEMARK OFFICE

CERTIFICATE OF CORRECTION

PATENT NO. : 5,079,867

DATED : January 14, 1992

INVENTOR(S) : Kasimir Kober and Martin Borucki

It is certified that error appears in the above-identified patent and that said Letters Patent is hereby corrected as shown below:

Column 2, line 15, change "or to" to --onto--.

Column 3, line 42, change "flatwork, automatic" to --flatwork. Automatic--.

Column 8, line 50, after "and" delete "B clamp conveyor" and insert --13. Clamp conveyor--.

Column 9, line 38, change "L/S" to --L/2--.

Column 9, line 50, change "is" to --it--.

Column 13, line 60, change "fed" to --feed--.

Column 13, line 63, change "2" to --1 or 2--.

Column 14, line 33, change "angels" to --angles--.

Column 14, line 62, after "conveyor" change "a" to --the--.

Column 15, line 13, after "end" insert --of--.

Column 16, line 18, change "flatwork stuffing" to --flatwork-stuffing--.

UNITED STATES PATENT AND TRADEMARK OFFICE

CERTIFICATE OF CORRECTION

PATENT NO. :5,079,867

DATED :1-14-1992

INVENTOR(S) : Kasimir Kober, et al.

It is certified that error appears in the above-indentified patent and that said Letters Patent is hereby corrected as shown below:

Column 16, line 40, change "further-folding" to --further folding --.

Signed and Sealed this

Ninth Day of November, 1993

*Attest:*

*Attesting Officer*

BRUCE LEHMAN

*Commissioner of Patents and Trademarks*